United States Patent [19]

Sitko et al.

[11] Patent Number: 4,503,992

[45] Date of Patent: Mar. 12, 1985

[54] DETACHABLE COVER FOR DISPOSABLE DRINKING CUPS, CONTAINER AND THE LIKE

[76] Inventors: Jerry A. Sitko, 412-5 Confederation Bay, Brandon, Manitoba, Canada, R7B 2P7; John Hrynkiw, 635 B St., Brandon, Manitoba, Canada; Marilyn I. Brazeau, P.O. Box 158, Erickson, Manitoba, Canada, R0J 0P0

[21] Appl. No.: 535,777

[22] Filed: Sep. 26, 1983

[30] Foreign Application Priority Data

Apr. 27, 1982 [CA] Canada ..... 426795

[51] Int. Cl.[3] ..... A47G 19/22

[52] U.S. Cl. ..... 220/90.4; 220/90.2; 229/7 R

[58] Field of Search ..... 220/90.4, 90.2, 90.6, 220/254; 229/7 R

[56] References Cited

U.S. PATENT DOCUMENTS

| | | | |
|---|---|---|---|
| 3,860,162 | 1/1975 | Schutz | 220/90.4 X |
| 4,056,210 | 11/1977 | Boyle | 220/90.4 |
| 4,113,135 | 9/1978 | Yamazaki | 220/90.4 X |
| 4,138,033 | 2/1979 | Payne et al. | 220/90.4 X |
| 4,184,604 | 1/1980 | Amberg et al. | 220/90.4 X |
| 4,186,842 | 2/1980 | Albert | 220/90.4 X |
| 4,210,256 | 7/1980 | Amberg et al. | 220/90.4 X |

*Primary Examiner*—Steven M. Pollard

*Attorney, Agent, or Firm*—Stanley G. Ade

[57] ABSTRACT

A snap-on type lid or cover is provided for plastic or paper cups or cartons used for hot or cold drinks which includes a mouth or drinking orifice integral therewith thereby enabling the user to drink the liquid without removing the cap or cover as is the usual practice. A flange depends downwardly around the inner periphery of the drinking aperture which is adjacent one side of the cover and this flange reduces spillage which might occur due to the inadvertent movement of the container, particularly when being used in a moving vehicle. An air hole is provided spaced from the drinking aperture with the entrance situated in a plane above the drinking aperture, to prevent spillage therefrom when drinking from the container.

20 Claims, 6 Drawing Figures

FIG. 1
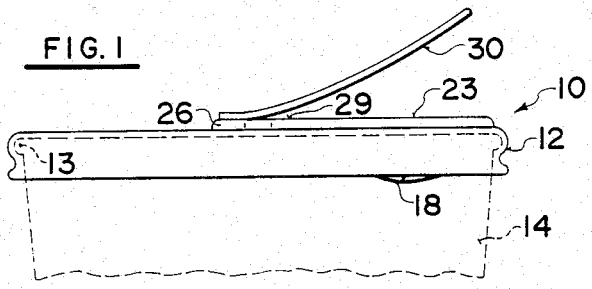
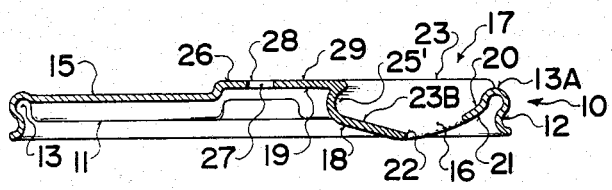
FIG. 2
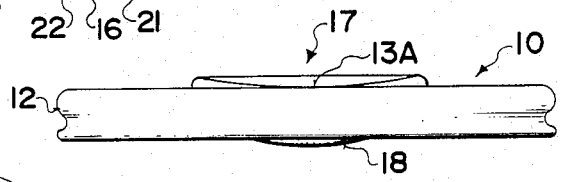
FIG. 3
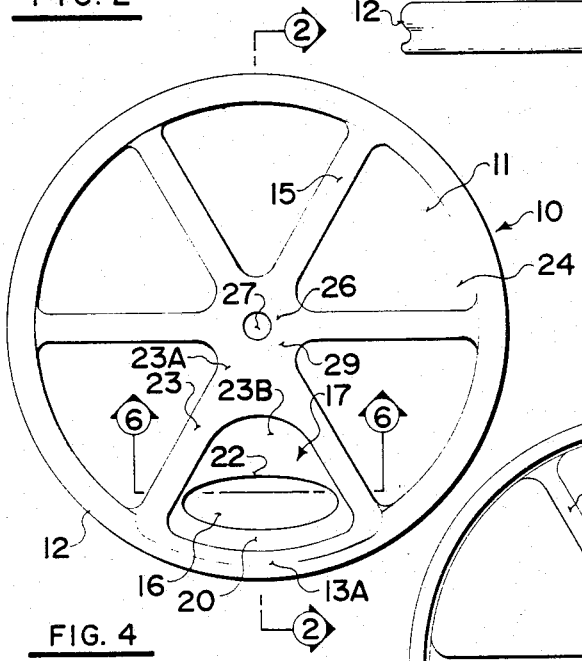
FIG. 4
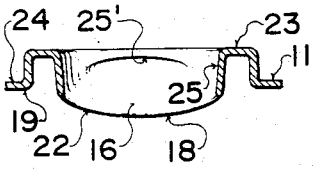
FIG. 6
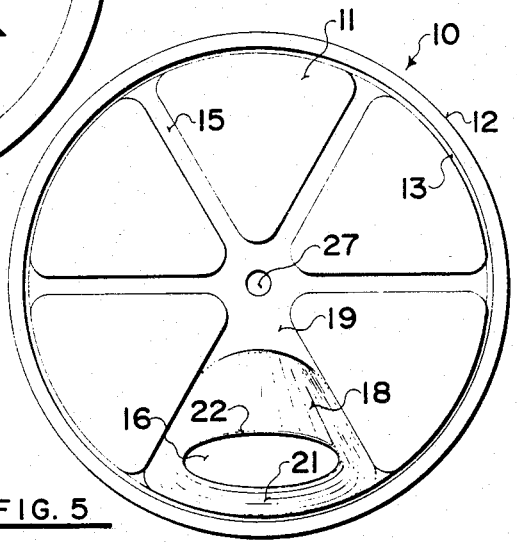
FIG. 5

DETACHABLE COVER FOR DISPOSABLE DRINKING CUPS, CONTAINER AND THE LIKE

BACKGROUND OF THE INVENTION

This invention relates to new and useful improvements to the detachable snap-on cap normally provided for hot or cold drinks, dispensed or pre-packaged in plastic or paper cups or containers.

These covers or caps are often placed on the open upper end of the container particularly if the container is to be removed from the premises and consumed elsewhere. Such covers or caps are also used when pre-packaged cold drinks are provided.

In the case of cold drinks, a small circular aperture is often provided with a detachable or frangible closure so that a drinking straw may be inserted through the aperture after the closure has been pierced and while this is satisfactory for cold drinks, it is not feasible to drink hot drinks such as coffee, tea, clear soups and the like, through a drinking straw so that it is normal for the purchaser to remove this plastic cap or cover from the upper end of the container prior to consuming the contents thereof. This is often a difficult procedure and spillage of the hot liquid often occurs during the removal process. Furthermore, when the cap or cover has been removed, spillage of the hot liquid often occurs due to inadvertent movement of the container, particularly if the hot liquid is being consumed in a moving vehicle such as a car and such spillage can be dangerous, particularly if spilled by the driver of the vehicle.

SUMMARY OF THE INVENTION

The present invention overcomes these disadvantages and although it is designed primarily for use with disposable cups containing hot liquids such as coffee and the like, nevertheless it can be used readily with cold drinks or beverages if desired.

In accordance with the invention there is provided a detachable cover for the upper open end of containers for hot or cold liquid beverages; comprising in combination a substantially circular panel, a peripheral attaching flange depending from the edge of the panel substantially perpendicular to the plane of the panel and including upper end engaging means around the inside of the junction between said panel and said flange to detachably snap engage the cover around the upper side of the associated container when installed thereon and a flanged area adjacent one edge of said panel surrounding and defining a drinking orifice formed through said panel, said flanged area including a flange portion of the underside of said panel extending downwardly and outwardly from the underside of the panel and defining a portion of said drinking orifice.

Another advantage of the invention is that the drinking orifice and the air intake aperture (if provided) can be detachably sealed with one of the conventional foil seals presently in use.

Another advantage of the invention is to provide a device of the character herewithin described which, if used with cold beverages, permits the insertion of a drinking straw through the drinking orifice if it is desired to consume the beverage through such a straw.

Yet another advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

FIG. 1 is a side elevation of the device with a sealing strip shown in the peeled back position.

FIG. 2 is a vertical cross section substantially along the line 2—2 of FIG. 4.

FIG. 3 is a view similar to FIG. 1 but taken at right angles thereto or from the right hand side of FIG. 1.

FIG. 4 is a top plan view of the device.

FIG. 5 is an underside plan view of the device.

FIG. 6 is a fragmentary enlarged cross sectional view along the line 6—6 of FIG. 4.

In the drawings like characters of reference indicate corresponding parts in the different figures.

DETAILED DESCRIPTION

Proceeding therefore to describe the invention in detail, the cap or cover is collectively designated 10 and is preferably formed from substantially flexible synthetic plastic or other suitable material normally used for such caps or covers.

It includes a substantially circular panel 11 having a downturned annular flange 12 formed around the periphery of the panel 11 and extending substantially perpendicular to the plane of the panel 11.

An annular recess 13 may be formed on the inner junction between the periphery of the panel 11 and the upper inner surface of the surrounding flange 12 to facilitate the snap engagement of the cover 10 with the upper open end 14 of a conventional container or cup which is also manufactured from synthetic plastic such as styrofoam, in the case of containers for hot beverages, or one of the flexible polyethylene plastics, if it is designed primarily for use with cold drinks. It can, of course, be used in conjunction with cups or containers made from other materials such as paper, cardboard or the like. This snap engaging facility is conventional and is not believed necessary to describe same further.

A plurality of radially extending ribs 15 may be formed integrally with the panel 11, if desired, for stiffening purposes.

A drinking orifice 16 is formed through the panel 11 adjacent the circumference thereof through which the liquid within the container 14, may be consumed either by means of a drinking straw (not illustrated) extending through the orifice or, by placing the container together with the cover, to the lips and drinking in the normal way.

A flanged area collectively designated 17 defines this drinking orifice, the drinking orifice preferably being substantially elliptical when viewed in plan with the longitudinal axis of the lips being situated substantially circumferential of the panel.

The flanged area 17 includes a flange portion 18 on the underside surface 19 of the panel 11 and extending downwardly and outwardly from the underside surface thereby defining the inner curve 20 of the substantially elliptical drinking orifice 16 and this flanged portion 18 blends into the under surface 19 as clearly shown in FIG. 2.

The inner surface 20 of the portion of the cover adjacent the junction between the panel 11 and the surrounding or attaching flange 12, slopes downwardly and inwardly in the flanged area 17 and defines the outer boundary of the elliptical drinking orifice and the underside edge 21 terminates spaced above the upper edge 22 of the flanged portion 18, once again clearly shown in FIG. 2.

A raised rib 23 extends from the outer junction 13A of the panel 11 and the attaching flange 12, towards the centre of the panel and surrounds the drinking orifice with the upper surface 23A of this rib lying in a plane spaced above the upper surface 24 of the panel 11 and the inner wall 25 of this rib, where it blends into the inner surface 23B of the flanged portion 18, inclines downwardly and outwardly so that the inner surface of this rib acts as a shroud to the drinking orifice around the rear or major portion thereof. If desired, a small concavity 25' may be provided adjacent the upper inner surface of the flanged portion 18, the purpose of which will hereinafter be described.

The aforementioned junction 13A between the panel 11 and the surrounding flange 12, where it spans and defines the front part of the drinking orifice, is slightly concave when viewed in front elevation as shown in FIG. 3 to facilitate engagement of the cover with the lips of the consumer.

A raised portion or boss 26 is formed on the upper surface 24 of the panel 11 spaced from the drinking orifice 16 and in this embodiment, this raised area is substantially in the centre of the panel 11. However, it can be at other locations if desired. An air intake aperture 27 extends through this raised portion so that the upper end 28 of the air intake aperture and the upper surface 29 of the raised portion is in a plane slightly above the upper side of the flanged area 17 defining the drinking orifice. This reduces the danger of liquid spilling through the air intake aperture when liquid is being consumed through the drinking orifice.

Finally, a flexible sealing strip 30 may be engaged with the raised area 26 and may detachably extend across the upper end 28 of the air intake aperture 27 and across the open upper area of the flanged area 17 thus enclosing the drinking orifice. This may be peeled back when it is desired to use the drinking orifice. However, such sealing strips are conventional on soft drink cans and the like so that it is not believed necessary to describe same further.

In operation, the container or cup 14 may be filled with the desired liquid, either hot or cold, and if cold, the contents may be pre-packaged with the cover snap engaged in place. However, when used for the dispensing of hot drinks such as coffee or the like, it is normal to fill the container or cup 14 and then snap engage the cover in place for consumption remote from the place of sale.

When it is desired to consume the contents, the sealing strip 30 (if provided) may be peeled back and if the contents are cold, a straw may be engaged through the drinking orifice 16 or, alternatively, it may be placed to the lips of the consumer so that the contents can be drunk through the drinking orifice 16 without removing the cover or cap from the container.

If a hot beverage is being consumed, then normally it would also be consumed through the drinking orifice 16 once the sealing strip 30 (if provided) has been peeled back.

The contours of the upper surface of the flanged area including the concave junction portion 13A, facilitate the easy consumption of the liquid through the drinking orifice 16 and reduces the chances of spillage occurring.

More importantly, agitation of the container either inadvertently or through the motion of a vehicle, results in very little if any spillage of the contents through the dispensing aperture 16 due to the configuration of the flanged area 17 and in particular to the configuration and location of the flanged portion 18 and the underside 21 of the front thereof. The recess or concavity 25', if provided, also tends to restrict spillage and allows the liquid to drain back into the container and the side walls 25 also assist in preventing the spillage from occurring. Experiments have shown that considerable sideways agitation can take place without liquid ejecting inadvertently through the drinking orifice 16.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What we claim as our invention is:

1. A detachable cover for the upper open end of containers for hot or cold liquid beverages; comprising in combination a substantially circular panel, a peripheral attaching flange depending from the edge of the panel substantially perpendicular to the plane of the panel and including upper end engaging means around the inside of the junction between said panel and said flange to detachably snap engage the cover around the upper side of the associated container when installed thereon and a flanged area adjacent one edge of said panel surrounding and defining a drinking orifice formed through said panel, said flanged area including a flange portion on the underside of said panel extending downwardly and outwardly from the underside of the panel and defining a portion of said drinking orifice.

2. The invention according to claim 1 in which said drinking orifice is substantially elliptical when viewed in plan and includes an arcuately curved inner boundary and an arcuately curved outer boundary with adjacent edge of said boundaries meeting one another, said orifice lying substantially parallel to the circumference of said cover.

3. The invention according to claim 2 in which the portion of the inner surface of said peripheral attaching flange constitutes the remainder of said flanged area and defines the remaining portion of said drinking orifice, said portion of said inner surface of said attaching flange sloping inwardly and downwardly from the junction of the panel and the attaching flange.

4. The invention according to claim 3 in which the portion of the junction between said panel and said attaching flange forming part of said flanged area is concavedly curved when viewed in front elevation.

5. The invention according to claim 4 which includes a rib formed on the upper surface of said panel and extending above the plane of said upper surface and defining the remaining part of said flanged area.

6. The invention according to claim 5 in which said flanged portion on the underside of said panel merges upwardly into said rib thereby forming the inner wall defining said drinking orifice and a concavity formed in said inner wall acting as a self-draining liquid trap against inadvertent spilling of liquid through said drinking orifice.

7. The invention according to claim 6 in which the inner surface of said rib is arcuately curved and slopes downwardly and outwardly from the upper side thereof towards the lower side thereof.

8. The invention according to claim 5 in which the inner surface of said rib is arcuately curved and slopes downwardly and outwardly from the upper side thereof towards the lower side thereof.

9. The invention according to claim 2 which includes a raised portion on said panel spaced from said drinking orifice surrounding an air intake aperture formed through said panel, the upper end of said raised portion and hence the upper end of said air intake aperture lying in a plane above the plane of the upper surface of said panel.

10. The invention according to claim 1 in which the portion of the inner surface of said peripheral attaching flange constitutes the remainder of said flanged area and defines the remaining portion of said drinking orifice, said portion of said inner surface of said attaching flange sloping inwardly and downwardly from the junction of the panel and the attaching flange.

11. The invention according to claim 10 in which the portion of the junction between said panel and said attaching flange forming part of said flanged area is concavedly curved when viewed in front elevation.

12. The invention according to claim 11 which includes a raised portion on said panel spaced from said drinking orifice surrounding an air intake aperture formed through said panel, the upper end of said raised portion and hence the upper end of said air intake aperture lying in a plane above the plane of the upper surface of said panel.

13. The invention according to claim 11 which includes a rib formed on the upper surface of said panel and extending above the plane of said upper surface and defining the remaining part of said flanged area.

14. The invention according to claim 13 in which the inner surface of said rib is arcuately curved and slopes downwardly and outwardly from the upper side thereof towards the lower side thereof.

15. The invention according to claim 13 which includes a raised portion on said panel spaced from said drinking orifice surrounding an air intake aperture formed through said panel, the upper end of said raised portion and hence the upper end of said air intake aperture lying in a plane above the plane of the upper surface of said panel.

16. The invention according to claim 13 in which said flanged portion on the underside of said panel merges upwardly into said rib thereby forming the inner wall defining said drinking orifice and a concavity formed in said inner wall acting as a self-draining liquid trap against inadvertent spilling of liquid through said drinking orifice.

17. The invention according to claim 16 in which the inner surface of said rib is arcuately curved and slopes downwardly and outwardly from the upper side thereof towards the lower side thereof.

18. The invention according to claim 16 which includes a raised portion on said panel spaced from said drinking orifice surrounding an air intake aperture formed through said panel, the upper end of said raised portion and hence the upper end of said air intake aperture lying in a plane above the plane of the upper surface of said panel.

19. The invention according to claim 10 which includes a raised portion on said panel spaced from said drinking orifice surrounding an air intake aperture formed through said panel, the upper end of said raised portion and hence the upper end of said air intake aperture lying in a plane above the plane of the upper surface of said panel.

20. The invention according to claim 1 which includes a raised portion on said panel spaced from said drinking orifice surrounding an air intake aperture formed through said panel, the upper end of said raised portion and hence the upper end of said air intake aperture lying in a plane above the plane of the upper surface of said panel.

* * * * *